US008544367B2

(12) United States Patent
Buchanan

(10) Patent No.: US 8,544,367 B2
(45) Date of Patent: Oct. 1, 2013

(54) SOCKET FOR A WRENCH

(76) Inventor: Nigel A. Buchanan, Fife (GB)

( * ) Notice: Subject to any disclaimer, the term of this patent is extended or adjusted under 35 U.S.C. 154(b) by 0 days.

(21) Appl. No.: 12/446,787

(22) PCT Filed: Oct. 23, 2007

(86) PCT No.: PCT/GB2007/004036

§ 371 (c)(1),
(2), (4) Date: Apr. 23, 2009

(87) PCT Pub. No.: WO2009/053665

PCT Pub. Date: Apr. 30, 2009

(65) Prior Publication Data

US 2011/0056337 A1 Mar. 10, 2011

(30) Foreign Application Priority Data

Oct. 23, 2006 (GB) ..... 0621027.2

(51) Int. Cl.
*B25B 13/06* (2006.01)
*B25B 13/08* (2006.01)

(52) U.S. Cl.
USPC ..... 81/124.5; 81/53.2; 81/90.2

(58) Field of Classification Search
USPC ..... 81/124.5, 115, 53.2, 128, 124.4, 81/185, 90.2, 186, 124.6
See application file for complete search history.

(56) References Cited

U.S. PATENT DOCUMENTS

| | | | | |
|---|---|---|---|---|
| 269,902 | A * | 1/1883 | Wheeler | 81/115 |
| 289,506 | A * | 12/1883 | Davidson | 81/115 |
| 2,681,582 | A * | 6/1954 | Valvano | 81/53.2 |
| 4,694,711 | A | 9/1987 | Yang | |
| 4,724,730 | A * | 2/1988 | Mader et al. | 81/53.2 |
| 4,843,926 | A * | 7/1989 | Bond | 81/185 |
| 5,123,310 | A | 6/1992 | McManus | |
| 5,178,047 | A | 1/1993 | Arnold et al. | |
| 5,315,902 | A * | 5/1994 | Ragland et al. | 81/53.2 |
| 5,467,672 | A | 11/1995 | Ashby | |
| 5,501,124 | A | 3/1996 | Ashby | |
| 5,709,137 | A | 1/1998 | Blacklock | |
| 5,713,251 | A | 2/1998 | Zurbuchen et al. | |
| 5,782,147 | A | 7/1998 | Chaconas et al. | |
| 5,794,496 | A | 8/1998 | Arnold | |
| 5,996,453 | A | 12/1999 | Blacklock | |

(Continued)

FOREIGN PATENT DOCUMENTS

| | | |
|---|---|---|
| DE | 203 08 050 | 9/2003 |
| WO | WO 0172475 | 10/2001 |

(Continued)

OTHER PUBLICATIONS

International Search Report and Written Opinion for corresponding PCT Application No. PCT/GB2007/004036, filed Oct. 23, 2007.

*Primary Examiner* — Hadi Shakeri

(74) *Attorney, Agent, or Firm* — Gardner, Linn, Burkhart & Flory, LLP

(57) ABSTRACT

A socket for a wrench comprises a fixed portion provided with a first fastener receiving aperture and a rotatable portion provided with a second fastener receiving aperture. The fixed and rotatable portions are disposed such that the first and second fastener receiving apertures are in overlying relationship to define a fastener receiving space and the rotatable portion is rotatable with respect to the fixed portion to adjust the fastener receiving space.

22 Claims, 9 Drawing Sheets

(56) References Cited

U.S. PATENT DOCUMENTS

| | | | | |
|---|---|---|---|---|
| 6,142,277 | A | 11/2000 | Barnett et al. | |
| 6,367,354 | B1 | 4/2002 | Mitchell | |
| 6,666,112 | B2 | 12/2003 | Hu | |
| 6,732,614 | B2 | 5/2004 | Hu | |
| 6,745,649 | B1 | 6/2004 | Liao | |
| 6,918,323 | B2 | 7/2005 | Arnold et al. | |
| 7,137,320 | B2 | 11/2006 | Tuan-Mu | |
| 7,146,881 | B2 | 12/2006 | Chang | |
| 7,222,557 | B2 | 5/2007 | Li et al. | |
| 7,299,720 | B1 | 11/2007 | Schultz et al. | |
| 7,418,890 | B2 * | 9/2008 | Buchanan | 81/124.4 |
| 7,752,946 | B2 * | 7/2010 | Wang | 81/124.6 |
| 2006/0150782 | A1 | 7/2006 | Hsieh | |
| 2006/0225538 | A1 * | 10/2006 | Brown | 81/90.2 |
| 2007/0227311 | A1 * | 10/2007 | Wang | 81/125 |
| 2009/0019973 | A1 * | 1/2009 | Nieh | 81/124.1 |

FOREIGN PATENT DOCUMENTS

| | | |
|---|---|---|
| WO | PCT/GB2002/004882 | 5/2003 |
| WO | PCT/GB2004/000525 | 8/2004 |
| WO | PCT/GB2004/001312 | 10/2004 |

* cited by examiner

SOCKET FOR A WRENCH

FIELD OF INVENTION

This invention relates to a socket to be used with a handle as a wrench (in Great Britain wrenches are referred to as spanners) which can be used for the purpose of tightening or slackening various types of nuts, bolts or screws (hereinafter referred to as fasteners).

BACKGROUND TO THE INVENTION

The head portion of a ring wrench or socket usually has an inner shape and size complementary to that of a typically hexagonal fastener head. The head of such a wrench has an inner surface, which surrounds the fastener head with only a small amount of play between the inner surface of the wrench or socket and the fastener head. As torque is applied to the wrench or socket the torque is transmitted to the fastener head to turn the fastener in the appropriate direction.

Ring-type sockets and wrenches are preferable to open jaw type wrenches and sockets as the torque applied to the wrench is transmitted to the fastener via a much larger contact area and the ring head of the socket or wrench Ring-type sockets and wrenches can also transmit far greater torque without harmful distortion of the fastener head and with less chance of the wrench or socket slipping off the fastener. However, if incorrectly sized, poor quality or open wrench has been used on a stubborn or tight fastener and the fastener head has become inoperable by reason of damage or corrosion, the fastener would normally require to be removed by other means than a socket or wrench. A further problem is that sometimes when using a wrench further purchase power may be required to tighten or slacken a fastener. Ring wrenches or sockets however can seldom be used to operate damaged or rounded fasteners, in particular those in recessed areas where the space surrounding the fastener head is restricted. Torque tightening wrenches which can operate partially rounded fasteners are known, but these normally require unrestricted access to the fastener head. These wrenches/sockets are incapable of operating severely damaged or worn fastener heads.

SUMMARY OF THE INVENTION

The invention provides a socket for a wrench, said socket comprising a fixed portion provided with a first fastener receiving aperture and a rotatable portion provided with a second fastener receiving aperture, said fixed and rotatable portions being disposed such that said first and second fastener receiving apertures are in overlying relationship to define a fastener receiving space and said rotatable portion being rotatable with respect to said fixed portion to adjust said fastener receiving space.

The invention also includes a method of loosening a fastener, said method comprising locating a socket having a fixed portion defining a plurality of fastener engaging faces and a rotatable portion having a plurality of fastener engaging faces over said fastener, applying a rotational force to said socket such that there is relative rotation between said fixed and rotatable portions to cause an adjustment of a fastener receiving space defined by said fastener engaging faces.

BRIEF DESCRIPTION OF THE DRAWINGS

Embodiments of the present invention will now be described by way of example, with reference to the accompanying drawings in which.

REFERENCE TO THE DRAWINGS

Figure 1:
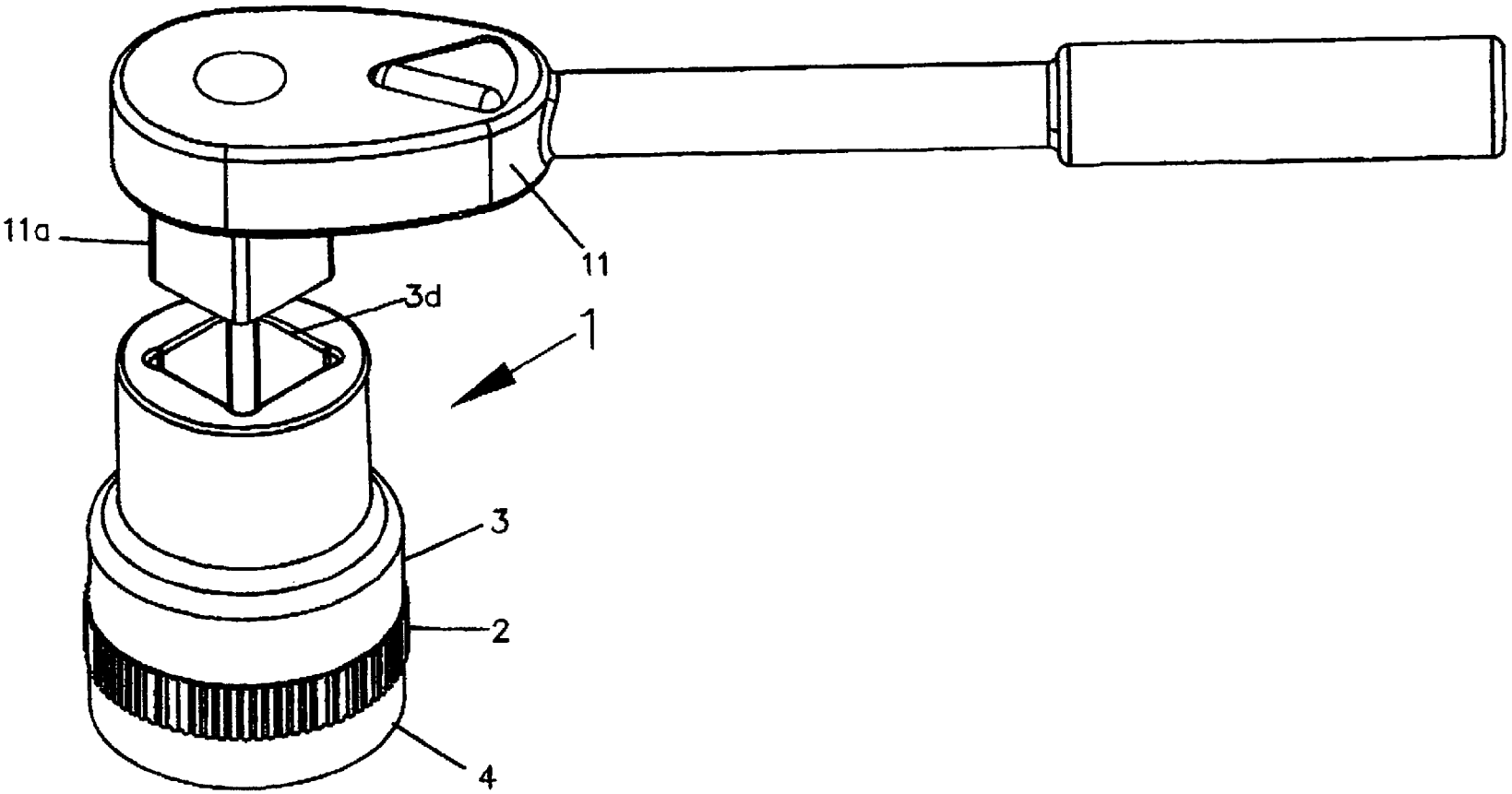
FIG. 1 illustrates in perspective a first embodiment of a socket for a wrench and a spigot drive ratchet for driving the socket.

In the drawings like features will be given like numbers as follows:

1. Socket for a wrench.
2. Rotatable ring portion.
2*a*. Rotational slots.
2*b*. Fastener drive surface.
2*c*. Fastener drive concave surface.
2*d*. Fastener drive convex surface.
2*e*. Corrugated surface.
2*f*. Rotatable ring incorporated post.
2*g*. Rotatable ring recess.
3. Socket body portion.
3*a*. Post fixing holes.
3*b*. Fastener drive surface.
3*c*. Housing inner recess.
3*d*. Drive spigot recess.
3*e*. Socket body housing.
3*f*. Socket body incorporated post.
3*g*. Socket body rotatable ring recess.
3*h*. Positioning mark.
3*i*. Positioning pin slot.

3*j*. Free end of housing inner recess
4. Fixed ring portion.
4*a*. Fixed ring post holes.
4*b*. Fixed ring fastener drive surface.
4*c*. Fastener drive surface recess.
4*d*. Post recess.
5. Post.
5*a*. Post fixed end.
5*b*. Post retention end.
7. Fixed wrench portion.
7*a*. Fixed wrench post retention holes.
7*b*. Fastener drive surface.
7*c*. Rotational ring portion slot.
8. Handle portion.
8*a*. Handle grip.
9. Fastener.
9*a*. Fastener drive surface.
9*b*. Fastener drive undulations.
9*c*. Worn/damaged fastener drive surface.
9*d*. Circular fastener drive surface.
10. Resilient portion.
D Drive direction
O Offset direction
A/F Across the flats
A/C Across the corners.
A 6 point.
B 12 point.
11. Spigot drive ratchet.
11*a*. Drive spigot.
12. Positioning pin.

DETAILED DESCRIPTION OF THE ILLUSTRATED EMBODIMENTS

FIG. 1 illustrates in perspective a first embodiment of a socket (1) for a wrench comprising a socket body (3), rotatable ring portion (2) and a fixed ring portion (4). The socket body (3) has a drive spigot recess (3*d*) complementary to a known drive spigot (11*a*) ratchet (11).

Figure 2:
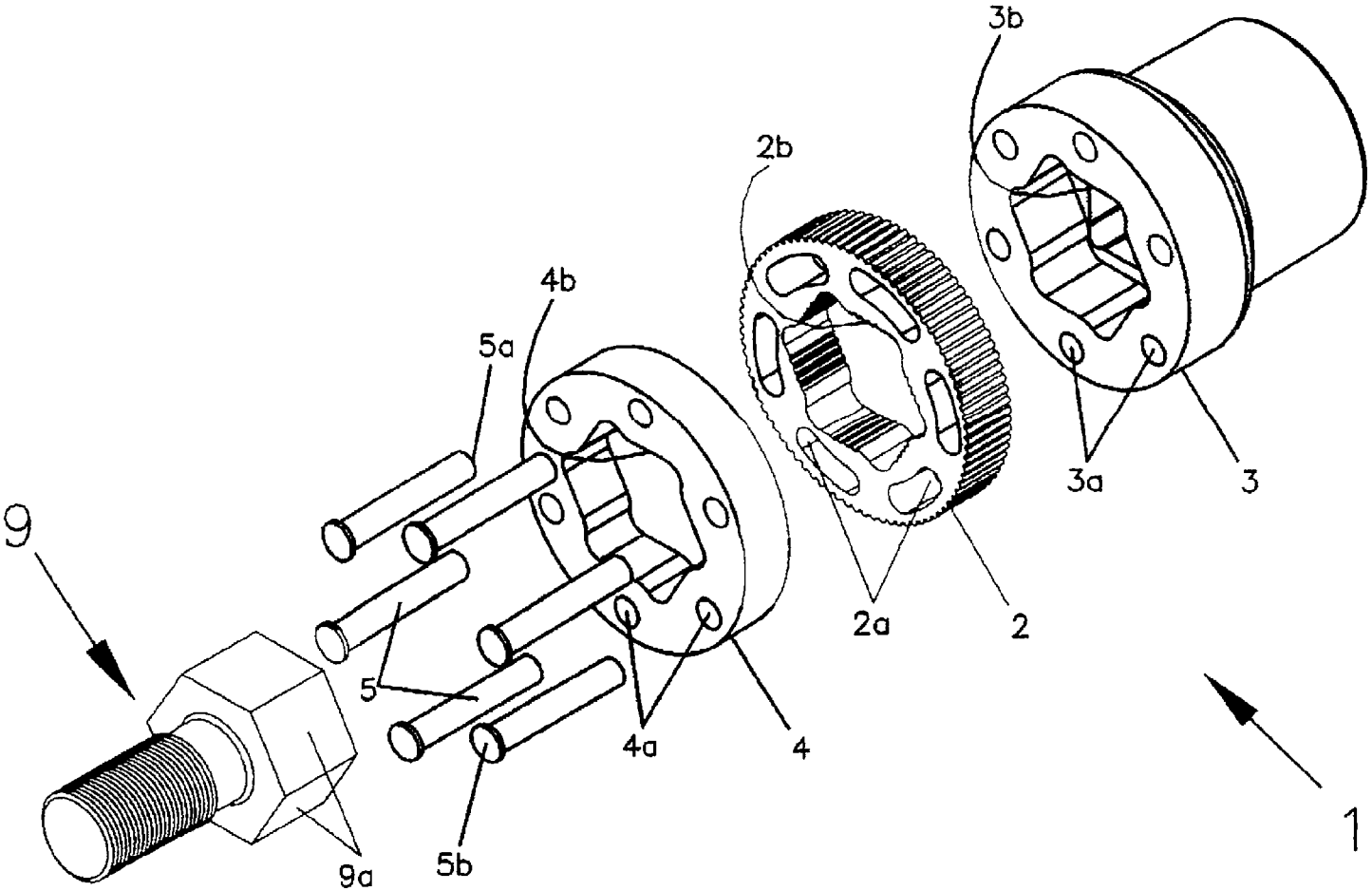
FIG. 2 illustrates in perspective the various component parts of the socket of FIG. 1.

FIG. 2 illustrates the socket (1) dismantled, showing it's various component parts, including the socket body portion (3) with it's post fixing holes (3*a*) in which respective ends (5*a*) of the posts (5) are retained. The rotatable ring portion (2) is restricted in rotational movement by the engagement of the posts (5) with the ends of the rotational slots (2*a*). The fixed ring portion (4) is suitably retained by the posts (5) within the fixed ring post holes (4*a*) and the post retention ends (5*b*) at their extremities. A fastener (9) with it's fastener drive surface (9*a*) is also illustrated.

Figure 3:
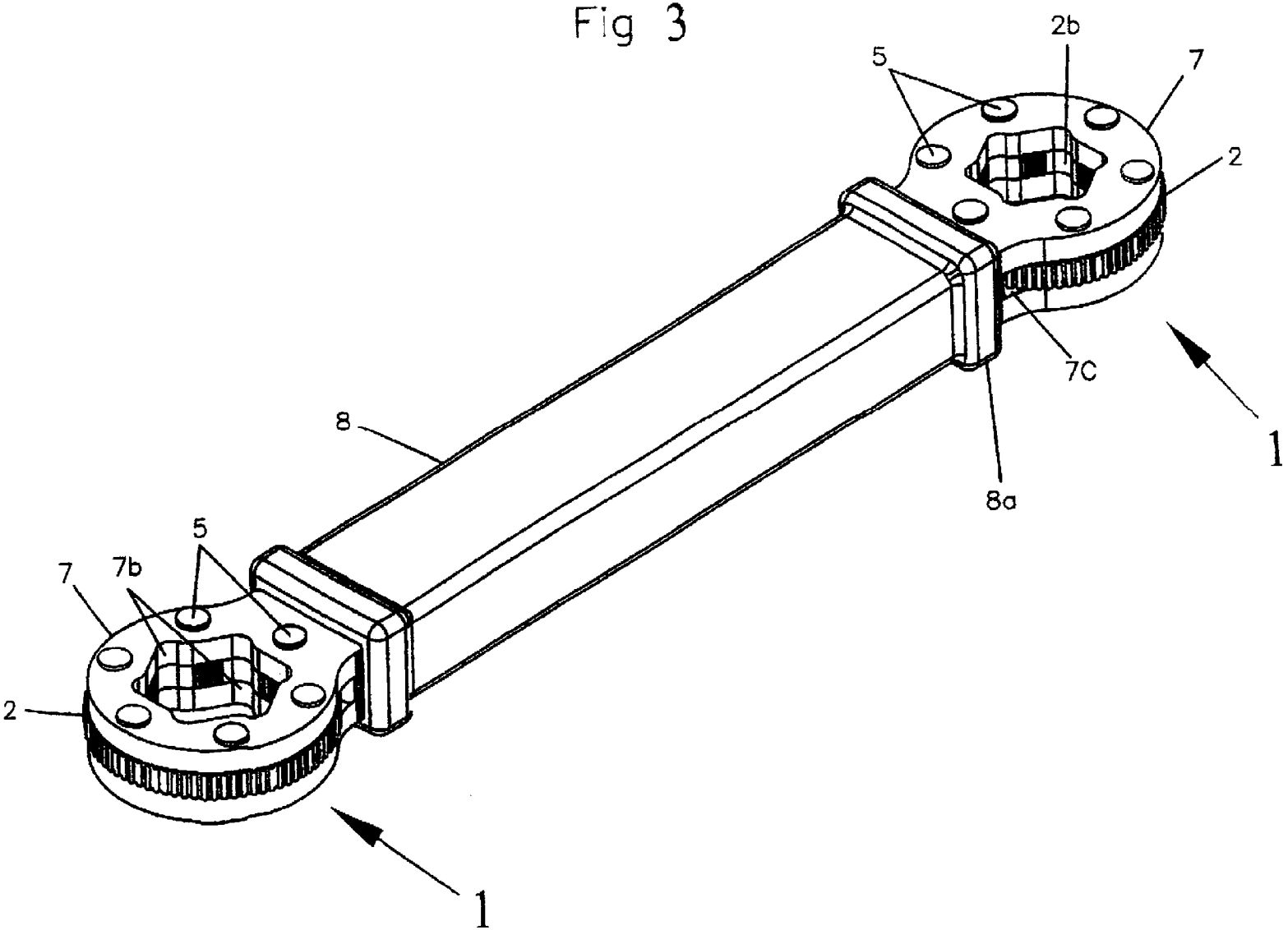
FIG. 3 illustrates in perspective a second embodiment of a socket in the form of a wrench head.

FIG. 3 shows a second embodiment of a socket (1) for a wrench in the form of a wrench head. The rotatable ring portion (2) is retained within a slot (7*c*) by the posts (5) and the fastener drive surface (2*b*) preferably has a polygonal surface similar to the profile of the fastener drive surface (7*b*) of the fixed wrench portion (7). A handle portion (8) with an optional grip (8*a*) has a socket (1).

Figure 4:
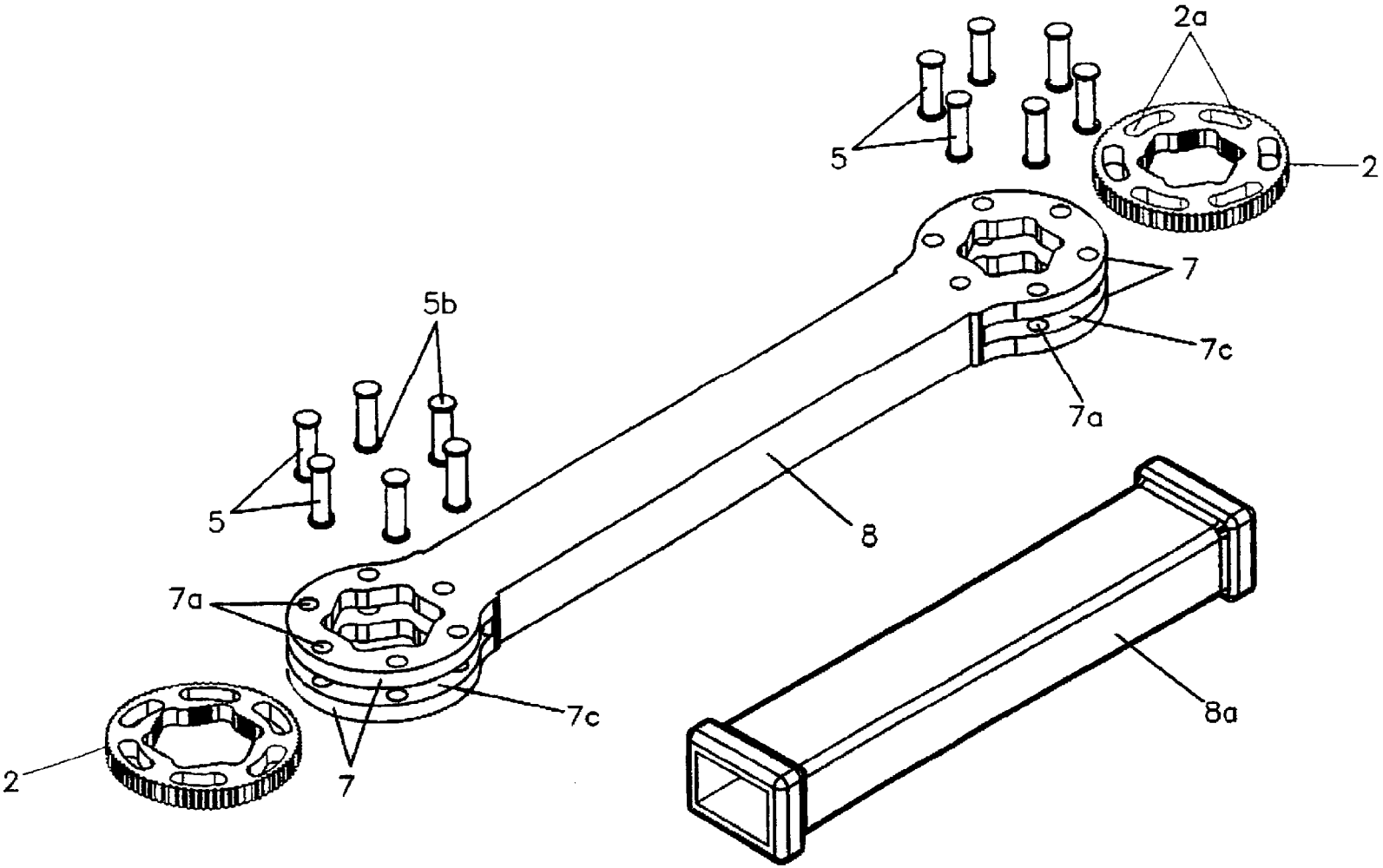
FIG. 4 illustrates in perspective the various component parts of the socket of FIG. 3.

FIG. 4 shows the various component parts of the wrench head form of the socket (1) illustrating the fixed wrench portion (7), the posts (5) with the post retention ends (5*b*) at either end which are fixed within the fixed ring post holes (7*a*) and through the rotational slots (2*a*) and the slots (7*c*) for the respective rotatable ring portions (2).

Figure 5B:
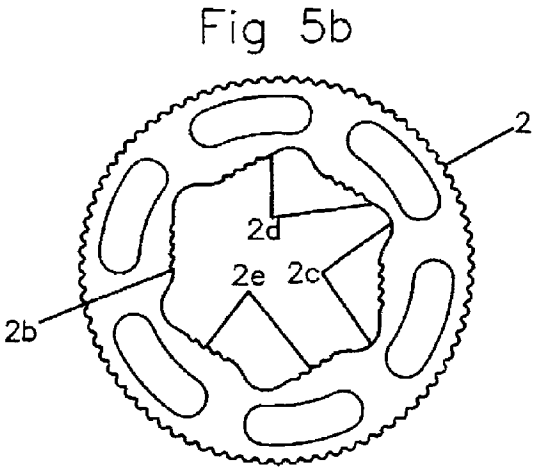
FIG. 5*b* shows a plan view of a rotatable ring portion of the socket of FIG. 1.
Figure 5D:
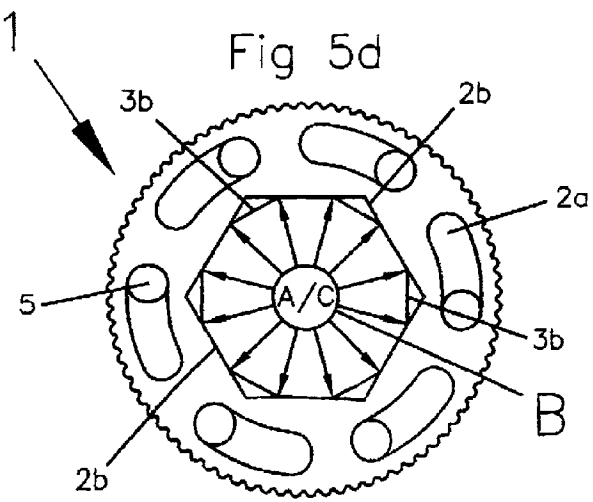
FIG. 5*d* illustrates in plan view the parts from FIG. 5*c* with the rotatable ring portion fully rotated in relation to the socket body.
Figure 5A:
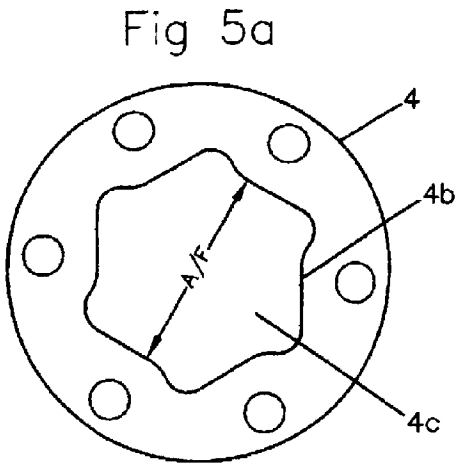
FIG. 5*a* illustrates in plan view a fixed ring portion of the socket of FIG. 1.

FIG. 5*a* shows an example of the fixed ring portion (4) of FIGS. 1 and 2 illustrating the across the flats (A/F) measurement within the fixed ring fastener drive surface (4*b*) recess (4*c*). The fastener drive surface (3*b*) of the socket body (3) corresponds to the fastener drive surface (4*b*).

FIG. 5*b* illustrates an example of the rotatable ring portion (2) having a fastener drive surface (2*b*) comprising a fastener drive concave surface (2*c*), a fastener drive convex surface (2*d*) and a further corrugated surface (2*e*).

Figure 5C:
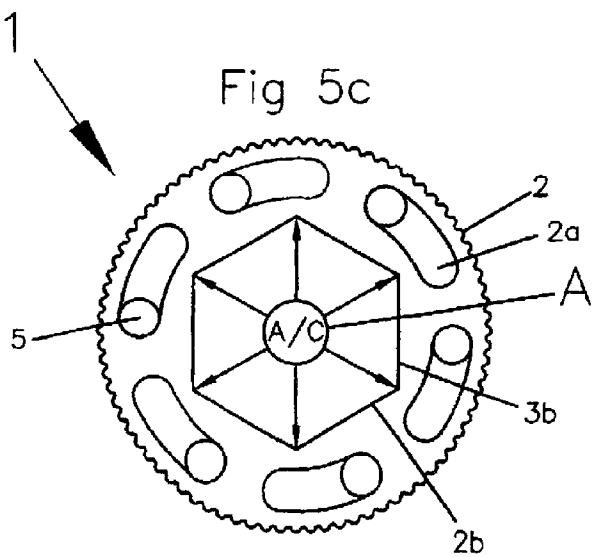
FIG. 5*c* illustrates in plan view parts of the socket of the socket of FIG. 1 at rest.

FIGS. 5*c* and 5*d* shows the socket (1) of FIGS. 1 and 2 with the said fixed ring portion (4) removed and the drive surfaces (2*b*) and (3*b*) shown flat for ease of representation. In FIG. 5*c*, the posts (5) are in their unoperated position in relation to the said rotational slots (2*a*). The flank drive or six point (A) fastener drive surfaces (2*b* and 3*b*) and the across the corners (A/C) measurement are also indicated. It will be appreciated that the six point (A) fastener drive surface (4*b*) and the A/C measurement for the fixed ring portion (4) corresponds to that of the socket body (3).

FIG. 5*d* shows the posts (5) in their fully operated position in relation to the rotational slots (2*a*). The six point (A) has now become a twelve point (B) composite of the fastener drive surfaces (2*b*, 3*b*) (and 4*b*) and usefully the said across the corners (A/C) measurement has also been substantially reduced.

Figure 6B:
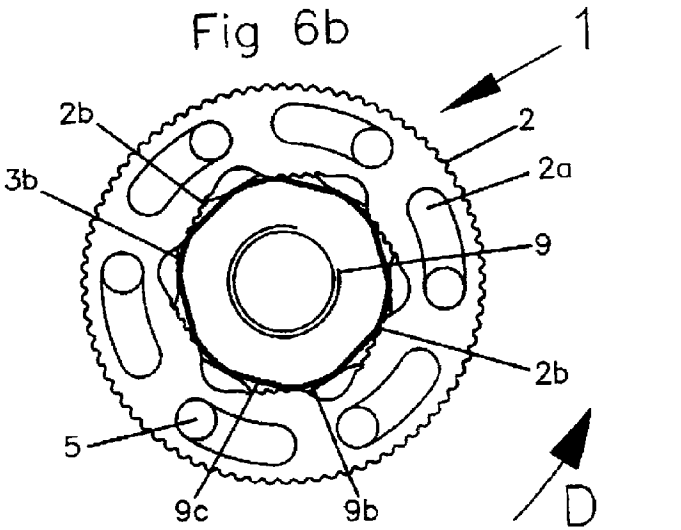
FIG. 6*b* illustrates in plan view the rotatable ring portion of FIG. 6*a* fully rotated in the drive direction.
Figure 6D:
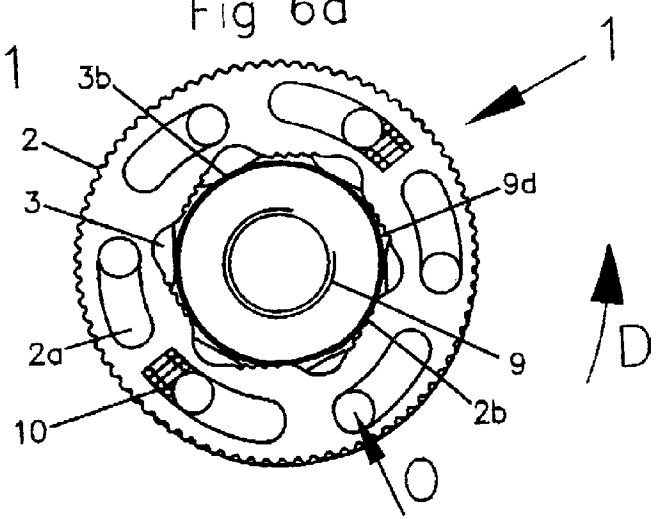
FIG. 6*d* illustrates in plan view the third embodiment with the rotatable ring portion is fully rotated.
Figure 6A:
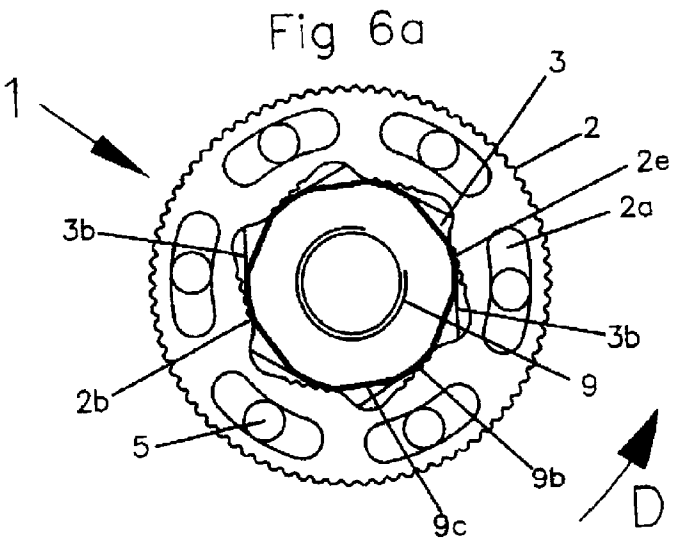
FIG. 6*a* illustrates in plan view parts of the socket of FIG. 1 engaged on a worn fastener drive surface with the rotatable ring portion partially rotated in the drive direction.

FIGS. 6*a* and 6*b* illustrate the socket (1) of FIGS. 1 and 2 with the fixed ring portion (4) removed and a worn/damaged fastener drive surface (9*c*) engaged by the rotatable ring portion (2) fastener drive surface (2*b*) and socket body portion (3) fastener drive surface (3*b*). When operated in the drive direction (D) the rotatable ring portion (2) rotates within the confines of the rotational slots (2*a*) restricted by the posts (5). In FIG. 6*a* the socket (1) is shown partially operated in the drive direction (D), yet imparting a substantial grip on the undersized, worn or damaged fastener drive surface (9*c*) via the remaining fastener drive undulations (9*b*). The corrugated surface (2*e*) provides further mechanical grip upon the worn or damaged fastener drive surface (9*c*). FIG. 6*b* shows the rotatable ring portion (2) fully operated imparting further grip on the fastener drive surface (9*b*, 9*c*).

When the socket (1) is operated in the drive direction (D) as in FIG. 6*a* and the rotatable ring portion (2) has sufficient grip on the fastener drive surface (9*c*) or is manually held and the socket body (3) further rotated in the drive direction (D), it's said fastener drive surfaces will come into contact with any undulations (9*b*) left on the damaged or worn fastener drive surface (9*c*) in an ever tightening manner until locked upon the damaged or worn fastener drive surface (9*c*). Any further torque applied to the socket (1) in the drive direction (D) is transmitted to the fastener (9) in order to operate the same. As shown in FIG. 6*b*, if the rotatable ring portion (2) is fully operated within the confines of the rotational slots (2*a*), the essentially "flank drive" or "six point" (A) that is illustrated in FIG. 5*c* is transformed into a the twelve point (B) of a smaller size shown in FIG. 5*d*. For example, an unoperated 17 mm A/F is approximately 19.8 mm widest A/C is transformed to an operated 17 mm widest A/C equivalent to 14.65 mm A/F.

It will be understood that the description of the operation of the parts (2), (3) and (4) given with reference to FIGS. 5*a* to 6*b* applies equally to the parts (2) and (7) of the second embodiment shown in FIGS. 3 and 4.

Figure 6C:
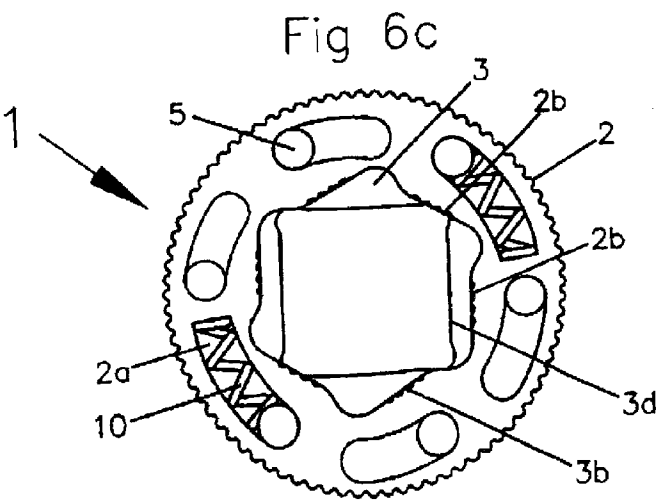
FIG. 6*c* illustrates in plan view parts of a third embodiment of a socket for a wrench.

FIGS. 6*c* and 6*d* illustrate in plan view a third embodiment of the socket (1) where, for illustration purposes only, the fixed ring portion (4) is removed. In this embodiment the rotatable ring portion (2) in relation to the socket body (3) is eccentric in that, as shown in FIG. 6*c*, initially the profiles of the at-rest socket body fastener drive surface (3*b*) and the rotatable ring portion (2) fastener drive surface (2*b*) are aligned but as shown in FIG. 6*d* when the rotatable ring portion (2) is rotated relative to the said socket body (3) the posts (5) act upon the suitably offset said rotational slots (2*a*) to cause the fastener drive surface (2*b*) to travel in the offset (O) direction, further reducing the said across corners (A/C) distance in that direction and thereby increasing the drive grip upon the fastener (9) to be operated enabling even a circular fastener drive surface (9*d*) to be operated.

FIGS. 6*c* and 6*d* further show in plan view the said rotatable ring portion (2) provided with bias members (10) in the form of springs fitted in the rotation slots (2*a*). The bias members 10 act against respective posts (5) to urge the rotatable ring portion (2) into the open position at which the fastener drive surfaces (2*b*, 3*b*) form a similar profile. FIG. 6*d* shows the rotatable ring portion (2) rotated in the drive direction (D) against the bias members (10), which are compressed to store a restoring force for restoring, or returning, the rotatable ring portion (2) to the open position.

Figures 7A, 7B:
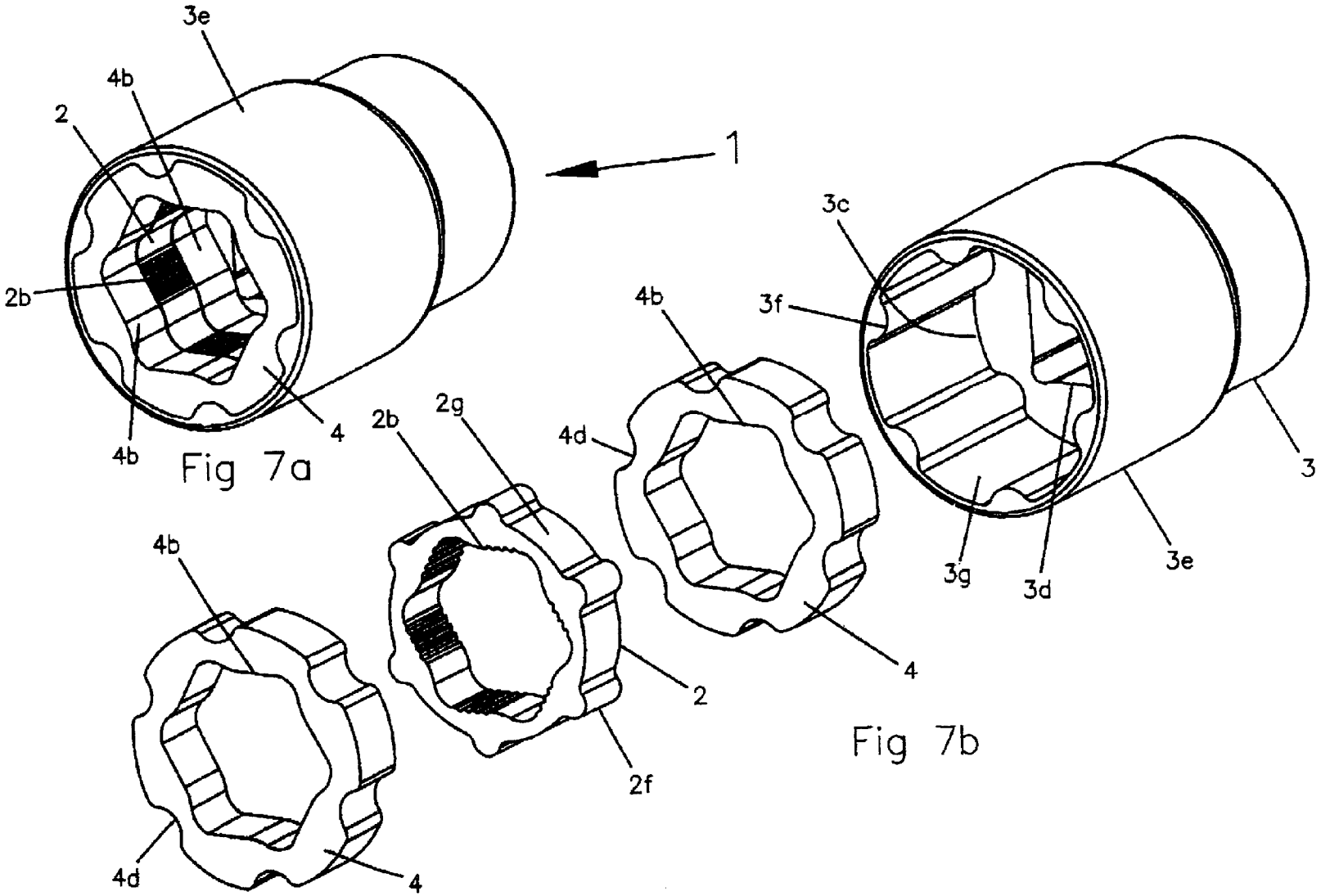
FIG. 7*a* illustrates in perspective view a fourth embodiment of a socket for a wrench.
FIG. 7*b* illustrates in perspective view the component parts of the fourth embodiment.

FIGS. 7*a* and 7*b* show a fourth embodiment of a socket (1) for a wrench which operates in the same general manner to that shown in FIG. 6*a* and FIG. 6*b*. As illustrated in FIG. 7*a*, when in the unoperated or at-rest position, the fastener drive surface (2*b*) is generally aligned with a fixed fastener drive surface (4*b*). In this embodiment, for ease of manufacture, the fastener drive surface (3*b*) of the socket body housing (3) of the FIGS. 1 and 2 embodiment has been replaced by a fastener drive surface (4*b*) defined by an inner fixed ring portion (4). An outer fixed ring portion (4) is fixed by known means to the socket body housing (3*e*). The outer profile of the fixed ring portions (4) incorporates post recesses (4*d*) which suitably interact with the socket body incorporated posts (3*f*) to prevent any movement between the socket body housing (3*e*) and the fixed ring potions (4). The rotatable ring portion (2) in this embodiment incorporates posts (2*f*) and recesses (2*g*) which interact with the socket body incorporated posts (3*f*) and rotatable ring recesses (3*g*) allowing the rotatable ring portion (2) to rotate within the socket body housing (3*e*) inner recess (3*c*) within the confines of the said posts (2*f*, 3*f*). In this embodiment the drive spigot recess (3*d*) is shown to be a known square drive.

Figures 8A, 8B:
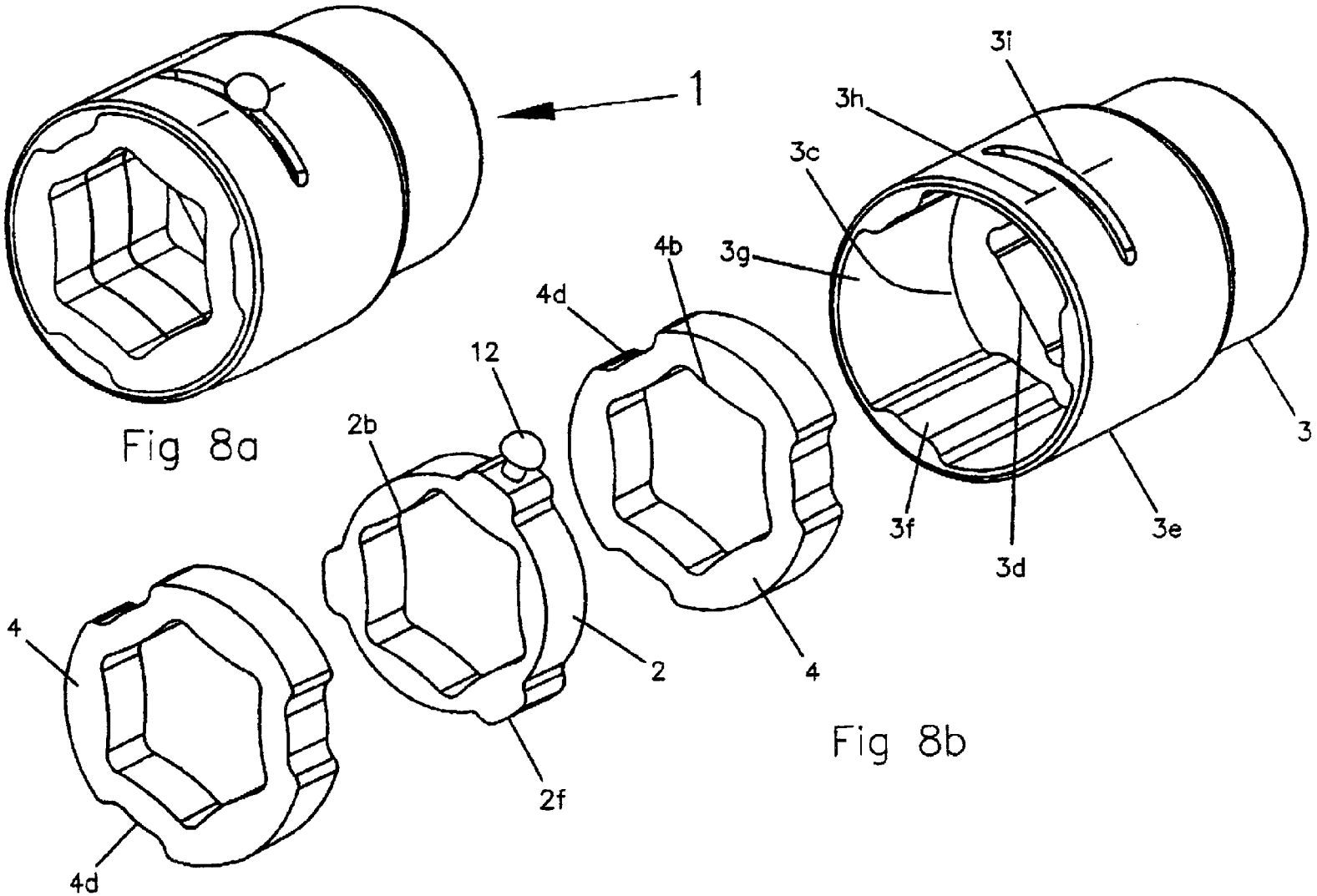
FIG. 8*a* illustrates in perspective view a fifth embodiment of a socket for a wrench.
FIG. 8*b* illustrates in perspective view the component parts of the fifth embodiment.
Figure 9C:
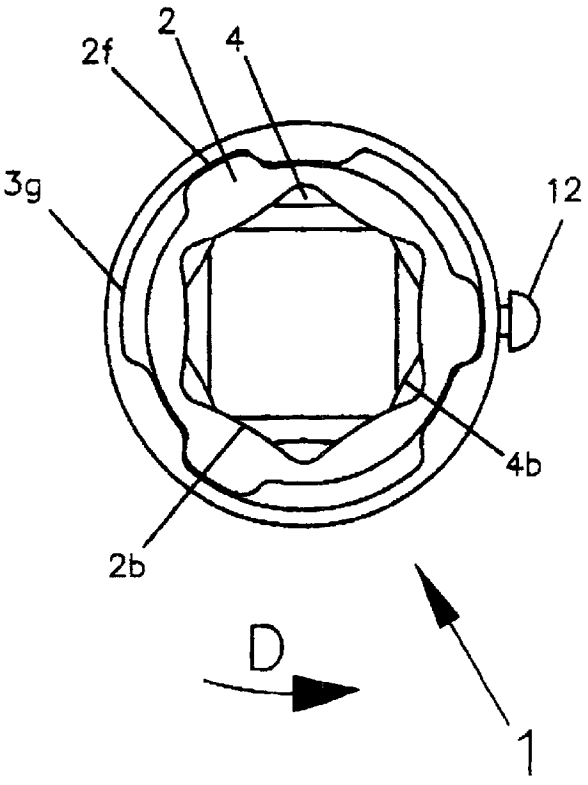
FIG. 9*c* illustrates in plan view the parts of the fifth embodiment shown in FIG. 9*a* fully operated in the anti-clockwise direction (30° in this example).
Figure 9B:
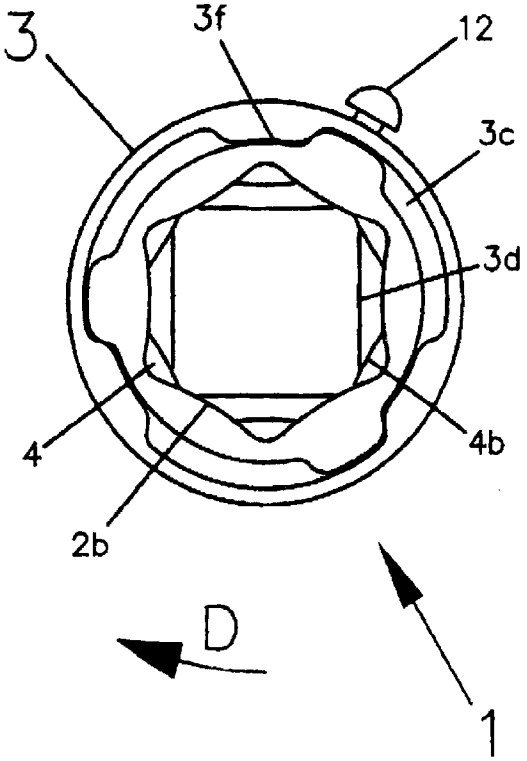
FIG. 9*b* illustrates in plan view the parts of the fifth embodiment shown in FIG. 9 fully operated in the clockwise direction (30° in this example)
Figure 9A:
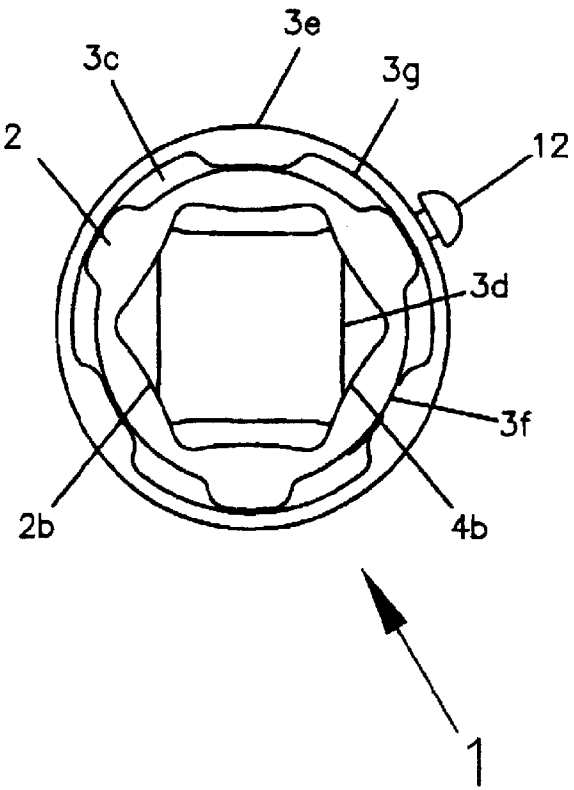
FIG. 9*a* illustrates in plan view parts of the fifth embodiment in the unoperated or at-rest position.

FIGS. 8*a*, 8*b*, 9*a*, 9*b* and 9*c* illustrate a fifth embodiment of a socket (1) for a wrench, which operates in the same general manner to that shown in FIGS. 6*a* and 6*b*. As shown in FIG. 8*a* when in the unoperated or at-rest position, the fastener drive surface (2*b*) of the rotatable ring portion (2) is generally aligned with the fastener drive surfaces (4*b*) of the fixed ring portion (4). A positioning pin (12) within a positioning pin slot (3*i*) enables manual alignment of the fastener drive surfaces (2*b*, 4*b*). The unoperated or at-rest position is visually indicated by a position mark (3*h*). The fixed ring portions (4) are held either side of the rotatable ring portions (2) within the socket body housing inner recess (3*c*). The outer profile of the fixed ring portions (4) incorporates post recesses (4*d*) which suitably interact with the socket body incorporated posts (3*f*) to prevent any movement between the socket body housing (3*c*) and the fixed ring portions (4). In this embodiment the rotatable ring portion (2) said incorporated posts (2*f*) and recesses (2*g*) interact with the socket body incorporated posts (3*f*) and said rotatable ring recesses (3*g*) to allow the rotatable ring portion (2) to rotate within the said socket body housing inner recess (3*c*) within the confines of the posts (2*f*, 3*f*). As illustrated in FIGS. 9*b* and 9*c*, in this embodiment the rotatable ring portion (2) is rotatable in both drive directions (D) from the unoperated or at-rest position shown in FIG. 9*a*. In this embodiment the fastener drive surfaces (2*b*, 4*b*) are generally convex. For illustration purposes the outer fixed ring portion (4) is not shown in FIGS. 9*a*, 9*b* and 9*c*.

The fourth and fifth embodiments shown in FIGS. 7*a* to 9*c* can be modified by reducing the length of three of the posts (3*f*) such that those posts do not extend to the free end (3*j*) of the housing inner recess (3*c*). The reduction in length of the three posts (3*f*) provides a seating for the outermost of the fixed ring portions (4*b*). The length of the three shortened posts (3*f*) should be such that the inner fixed ring portion (4*b*) and the rotatable ring portion (2) can fit behind the outermost fixed ring portion (4*b*) with sufficient clearance to allow the rotatable ring portion to rotate. Using this arrangement simplifies manufacture by providing a set clearance for the rotatable ring portion (2*b*) that will not be affected by the fixing of the outermost ring portion (4*b*) in the inner housing recess (3*c*). The outermost fixed ring portion (4*b*) can be secured in the housing inner recess (3*c*) by, for example, crimping or welding.

It will be understood that the fourth and fifth embodiments shown in FIGS. 7*a* to 9*c* can be modified by providing a greater number of rotatable ring portions (2) and fixed ring portions (4). For example, there could be a total of five or seven portions (2) and (4) disposed in the housing inner recess (3*c*). As shown in FIGS. 7*b* and 8*b*, the ring portions (2) and (4) preferably alternate. Thus in a seven ring portion arrangement, an innermost fixed ring portion (4) would be located at the inner end of the housing recess (3*c*) followed by a rotatable ring portion (2), another fixed ring portion (4), another rotatable ring portion (2), yet another fixed ring portion (4), yet another rotatable ring portion (2) and an outermost fixed ring portion (4). As previously described, the outermost fixed ring portion (4) preferably seats on the ends of a number of shortened posts (3*f*).

In modifications of the fourth and fifth embodiments in which the outermost fixed ring portion (4) seats on the ends of a number of shortened posts (3*f*), the number of post recesses (4*f*) provided in the outermost fixed ring portion may be reduced in number to take account of the number of shortened posts (3*f*). Thus, if number of posts (3*f*) that are shortened is three, the outermost ring portion (4) has three fewer post recesses (4*f*) than any other fixed ring portion (4).

It will be appreciated that features of the illustrated embodiments may be combined to form new embodiments. For example, the offset feature shown in FIGS. 6*c* and 6*d* can be incorporated in either of the embodiments shown in FIGS. 7*a* to 9*c*, so increasing the number of fastener head drive (9*a*) sizes the sockets (1) can usefully operate. This can be achieved by offsetting the respective axes of the apertures that define the fastener drive surfaces (2*b*), (4*b*) such that as the rotatable ring portion (2) rotates relative to the fixed ring portions (4) the fastener drive surface (2*b*) effectively makes a translational movement with respect to the fastener drive surfaces (4*b*).

In the embodiments, the sockets (1) each have one or more rotatable ring portions (2) sandwiched between parts (3), (4) or (7) that define fixed fastener drive surfaces (3*b*), (4*b*) or (7*b*) fixed. This is not essential. The socket may comprise just one rotatable ring portion cooperating with just one fixed fastener drive surface (3*b*), (4*b*) or (7*b*). As shown in FIGS. 1 and 2, the fixed fastener drive surface can be formed in the socket body portion (3) or, as shown in FIGS. 7*a* and 8*a*, the fixed fastener drive surface can be formed in a separate generally annular member fitted to the socket body portion.

It will be appreciated that when used in a wrench with an integral fixed handle as shown in FIGS. 3 and 4, the drive direction is easily reversed by the flipping or turning the wrench through 180°.

It will be understood that the fastener drive surfaces of the socket may be configured to allow a wide variety of size of fasteners to be operated by the same socket. For example, the fastener drive surfaces can enable the operation of both an as new 19 mm A/F fastener head and when fully operated an as new 16 mm A/F fastener head. Thus the socket can operate across a range of fastener sizes. In an another example a socket (1) can be configured such that unoperated the fastener receiving space is effectively 17 mm A/F (across/flats) and approximately 19.8 mm widest across the corners and by rotation of the rotatable portion can be adjusted to 17 mm widest across the corners, which is equivalent to 14.65 mm A/F.

The or each rotatable ring portion of the socket can be made capable of rotating in both directions from a mid at-rest or unoperated point (for example, 30° in either direction). This makes the socket capable of operating undersized fasteners (within it's size limitations) in either rotational direction so that it can be used for both tightening and undoing such a fastener.

It will be appreciated that the illustrated embodiments provide a socket that can be used to remove worn or damaged fasteners. When engaged upon a worn fastener drive surface, the rotatable ring portion is preferably held still while the socket is rotated. As the socket is rotated, its fastener drive surfaces come into contact with any undulations left on the fastener drive surface in an ever-tightening manner until locked upon the fastener drive surface. Any further torque applied to the socket is transmitted to the fastener to turn the fastener.

The invention claimed is:

1. A socket for a wrench, said socket comprising:

a fixed portion provided with a first polygonal fastener receiving aperture that has a circumference that defines a plurality of first fastener engaging surfaces;

a rotatable portion provided with a second polygonal fastener receiving aperture that has a circumference that defines a plurality of second fastener engaging surfaces; and a formation configured to releasably engage a drive formation of a drive device to receive a torque input from said drive device, wherein said fixed and rotatable portions are disposed such that said first and second polygonal fastener receiving apertures are in overlying relationship to define a fastener receiving space that has an axis of rotation and an open condition in which said first and second fastener engaging surfaces are substantially aligned in an axial direction of the fastener receiving space to provide a corresponding first number of fastener engaging faces, and wherein relative rotation of said fixed and rotatable portions in a circumferential direction of said first and second polygonal fastener receiving apertures moves said first and second fastener engaging surfaces out of said alignment to increase the number of fastener engaging faces to twice said first number.

2. A socket for a wrench as claimed in claim 1, wherein said second polygonal fastener receiving aperture lines in a plane and said rotatable portion is rotatable in said plane.

3. A socket for a wrench as claimed in claim 1, wherein said first and second fastener engaging surfaces comprise a convex central portion.

4. A socket for a wrench as claimed in claim 3, wherein said convex portions each have a peak located off centre in the lengthways direction of the respective fastener engaging surfaces.

5. A socket for a wrench as claimed in claim 1, comprising a plurality of said fixed portions having a said rotatable portion disposed therebetween.

6. A socket for a wrench as claimed in claim 1, wherein the rotatable portion is provided with a plurality of recesses in which are received respective fixed members, said recesses and fixed members cooperably guiding rotation of said rotatable portion.

7. A socket for a wrench as claimed in claim 6, wherein said recesses are arranged to cooperate with said fixed members to cause translation of said rotatable portion during at least a portion of the rotational movement thereof.

8. A socket for a wrench as claimed in claim 1, comprising a body defining a housing for said rotatable portion, said rotatable portion being provided with guide portions that interengage fixed guide portions carried by said body.

9. A socket for a wrench as claimed in claim 8, wherein said fixed guide portions are defined by said body.

10. A socket for a wrench as claimed in claim 8, wherein said rotatable portion has a periphery, said guide portions of the rotatable portion are recesses in said periphery and said fixed guide portions are elongate protrusions provided in said housing.

11. A socket for a wrench as claimed in claim 8, wherein said guide portions of the rotatable portion and said fixed guide portions are arranged to cooperate to cause translation of said rotatable portion during at least a portion of the rotational movement thereof.

12. A socket for a wrench as claimed in claim 8, wherein said fixed guide portions comprise first fixed guide portions having ends spaced from an end of said housing and defining seating for a said fixed portion, said ends defining a clearance for said rotatable portion in which said rotatable portion can rotate.

13. A socket for a wrench as claimed in claim 12, wherein said fixed guide portions comprise second fixed guide portions that engage cooperating portions of the fixed portion seated on said seating to locate said fixed portion in said housing.

14. A socket for a wrench as claimed in claim 8, comprising a member projecting from said housing and connected with said rotatable portion whereby a user can rotate the rotatable portion in said housing to a required position.

15. A socket for a wrench as claimed claim 1, comprising at least one biasing member for biasing said rotatable portion to a position at which said fastener receiving space is at its maximum size.

16. A socket for a wrench as claimed in claim 1, wherein said rotatable portion is a ring element and said rotation relative to said fixed portion is in a circumferential direction of said ring element.

17. A wrench comprising a handle portion having a socket at an end thereof, said socket being integral with said handle portion and comprising a fixed portion provided with a first polygonal fastener receiving aperture that has a circumference that defines a plurality of first fastener engaging surfaces and a rotatable portion provided with a second polygonal fastener receiving aperture that has a circumference that defines a plurality of second fastener engaging surfaces, wherein said fixed and rotatable portions are disposed such that said first and second polygonal fastener receiving apertures are in overlying relationship to define a fastener receiving space that has an axis of rotation and an open condition in which said first and second fastener engaging surfaces are substantially aligned in an axial direction of the fastener receiving space to provide a corresponding first number of fastener engaging faces, and wherein relative rotation of said fixed and rotatable portions in a circumferential direction of said first and second polygonal fastener receiving apertures moves said first and second fastener engaging surfaces out of said alignment to increase the number of fastener engaging faces to twice said first number.

18. A wrench as claimed in claim 17, wherein said rotatable portion is a ring element and said rotation relative to said fixed portion is in a circumferential direction of said ring element.

19. A method of loosening a fastener, said method comprising:

locating a socket over said fastener, said socket having a fixed portion defining a plurality of first fastener engaging surfaces equal to a first number and a rotatable ring element having a plurality of second fastener engaging surfaces equal to a second number; and applying a rotational force to said socket such that there is relative rotation between said fixed portion and said rotatable ring element in a circumferential direction of said ring element to cause an adjustment of a fastener receiving space defined by said first and second fastener engaging surfaces by relative movement of said first and second fastener engaging surfaces from an open position in which said fastener receiving space has a number of fastener engaging faces equal to said first number to a closed position in which said fastener engaging space has a number of fastener engaging faces equal to the sum of said first and second numbers, wherein said fastener receiving space has an axis of rotation and in said open position said first and second fastener engaging surfaces are substantially aligned in an axial direction of said fastening receiving space and in said closed position said first and second fastener engaging surfaces are out of alignment in said axial direction.

20. A method of loosening a fastener as claimed in claim 19, including restraining said rotatable portion to cause said relative rotation.

21. A socket for a wrench, said socket comprising:

a fixed portion provided with a plurality of first fastener receiving apertures, each of said first fastener receiving apertures being a polygonal aperture that defines a plurality of fastener engaging surfaces; and a rotatable portion disposed between said first fastener receiving apertures provided with a second fastener receiving aperture, said second fastener receiving aperture being a polygonal aperture that defines a plurality of fastener engaging surfaces, wherein said first fastener receiving apertures and said second fastener receiving apertures have substantially the same polygonal configuration, wherein said fixed and rotatable portions are disposed such that said first and second fastener receiving apertures are in overlying relationship to define a fastener receiving space and said rotatable portion is rotatable with respect to said fixed portion to adjust said fastener receiving space by moving from an open position in which said fastener engaging surfaces of the first and second fastener receiving apertures are substantially aligned to provide a corresponding first number of fastener engaging faces and a closed position in which said fastener engaging surfaces are out of alignment to increase the number of fastener engaging faces to twice said first number, and wherein said rotatable portion is a ring element and said rotation relative to said fixed portion is in a circumferential direction of said ring element.

22. A socket for a wrench, said socket comprising:

a plurality of fixed portions each provided with a first polygonal fastener receiving aperture that has a circumference that defines a plurality of first fastener engaging surfaces;

a rotatable portion provided with a second polygonal fastener receiving aperture that has a circumference that defines a plurality of second fastener engaging surfaces, said rotatable portion disposed between said fixed portions;

a body defining a housing for said rotatable portion and fixed portions, said rotatable portion being provided with guide portions that interengage fixed guide portions carried by said body; and a formation configured to releasably engage a drive formation of a drive device to receive a torque input from said drive device, wherein said fixed and rotatable portions are disposed such that said first and second polygonal fastener receiving apertures are in overlying relationship to define a fastener receiving space that has an axis of rotation and an open condition in which said first and second fastener engaging surfaces are substantially aligned in an axial direction of the fastener receiving space to provide a corresponding number of first fastener engaging faces, and wherein relative rotation of said fixed and rotatable portions in a circumferential direction of said first and second polygonal fastener receiving apertures moves said first and second fastener engaging surfaces out of said alignment to increase the number of fastener engaging faces to twice said first number.

* * * * *